US010145216B2

(12) United States Patent
Wise et al.

(10) Patent No.: US 10,145,216 B2
(45) Date of Patent: Dec. 4, 2018

(54) DETERMINING DOMINANT SCENARIOS FOR SLOWING DOWN TRIP SPEEDS

(71) Applicant: Landmark Graphics Corporation, Houston, TX (US)

(72) Inventors: Matthew Edwin Wise, Sugar Land, TX (US); Gustavo Adolfo Urdaneta, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 15/523,705

(22) PCT Filed: Dec. 2, 2014

(86) PCT No.: PCT/US2014/068032
§ 371 (c)(1),
(2) Date: May 2, 2017

(87) PCT Pub. No.: WO2016/089364
PCT Pub. Date: Jun. 9, 2016

(65) Prior Publication Data

US 2017/0314368 A1 Nov. 2, 2017

(51) Int. Cl.

| | |
|---|---|
| ***E21B 41/00*** | (2006.01) |
| ***E21B 21/08*** | (2006.01) |
| E21B 19/00 | (2006.01) |
| ***E21B 47/06*** | (2012.01) |
| ***E21B 47/09*** | (2012.01) |

(52) U.S. Cl.
CPC ..... *E21B 41/0092* (2013.01); *E21B 19/008* (2013.01); *E21B 21/08* (2013.01); *E21B 47/06* (2013.01); *E21B 47/09* (2013.01)

(58) Field of Classification Search
CPC .... E21B 41/0092; E21B 21/08; E21B 49/003; E21B 44/00; E21B 44/06; E21B 45/00;
(Continued)

(56) References Cited

U.S. PATENT DOCUMENTS

| | | | |
|---|---|---|---|
| 4,566,318 | A | 1/1986 | Rao et al. |
| 8,527,249 | B2 | 9/2013 | Jamison et al. |

(Continued)

FOREIGN PATENT DOCUMENTS

| | | | |
|---|---|---|---|
| CA | 2930534 | A1 | 5/2015 |
| KR | 1020140011575 | A | 1/2014 |
| WO | 2014105055 | A1 | 7/2014 |

OTHER PUBLICATIONS

Bill Chmela, Nicholas Gibson, Egill Abrahamsen, and Ronny Bergerud, Society of Petroleum Engineers International, IADC/SPE 168018, Safer Tripping Through Drilling Automation, Mar. 4, 2014.

(Continued)

*Primary Examiner* — George S Gray
(74) *Attorney, Agent, or Firm* — Howard L. Speight, PLLC

(57) ABSTRACT

A trip speed table is created containing records. Each record contains a step location, wherein a step is defined to be the location in a well of a deepest end of a drill string, a minimum trip speed for the step location, wherein the minimum trip speed is defined to be the maximum trip speed less than or equal to a default trip speed at which the drill string can be tripped without exceeding a fracture gradient or falling below a pore pressure at a slice depth, and the slice depth where the minimum trip speed for the step location occurred.

12 Claims, 11 Drawing Sheets

(58) Field of Classification Search
CPC ..... E21B 47/06; E21B 47/09; E21B 19/00; E21B 19/008; G01V 99/005; G01V 2210/74; G01V 2210/66; G01V 2210/64; G01V 2210/72; G06F 2217/16
See application file for complete search history.

(56) References Cited

U.S. PATENT DOCUMENTS

| | | | | |
|---|---|---|---|---|
| 8,798,974 | B1 * | 8/2014 | Nunns | G01V 99/005 702/16 |
| 2004/0236513 | A1 | 11/2004 | Tutuncu et al. | |
| 2010/0282482 | A1 | 11/2010 | Austin et al. | |
| 2012/0227961 | A1 | 9/2012 | Sehsah | |
| 2013/0341091 | A1 | 12/2013 | Sugiura | |
| 2014/0326449 | A1 | 11/2014 | Samuel et al. | |
| 2015/0142318 | A1 * | 5/2015 | Hildebrand | E21B 44/06 702/9 |

OTHER PUBLICATIONS

M.J. Bible, Z. Hedayati, D.K. Choo, Society of Petroleum Engineers, SPE/IADC 21965, State of the Art Trip Monitor, entire document, Mar. 11, 1991.

Manohar Lal, IAD/SpE, Surge and Swab Modeling for Dynamic Pressures and Safe Trip Velocities, entire document Feb. 20, 1983.

Republique Francaise, Institut National De La Propriete Industrielle, Rapport De Recherche Preliminaire (Preliminary Search Report), entire document, N d' enregistrement national FR 1559985, which is an FR counterpart to the instant application, Mar. 9, 2018.

Republique Francaise, Instituy National De La Propriete Industrielle, Opinion Ecrite Sur La Brevetabilite De L'Invention, N d' enrgistrement national FR1559985, which is an FR counterpart to the instant application, Mar. 9, 2018.

Rudi Rubiandini R.S., Society of Petroleum Engineers, SPE 64480, New Formula of Surge Pressure for Determining Safe Trip Velocities, entire document, Oct. 16, 2000.

G. Robello Samuel, Aswin Sunthankar, Glen McColpin, Peter Bern, Tim Flynn, Society of Petroleum Engineers, SPE/IADC 67717, Field Validation of Transient Swab/Surge Response with PWD Data, entire document, Feb. 27, 2001.

Innovation, Science and Economic Development Canada, Canadian Intellectual Property Office, Examiner's Requisition, Application No. 2,965,645, entire document, which is a CA counterpart to the instant application, Feb. 23, 2018.

International Searching Authority, International Search Report and Written Opinion, International application No. PCT/US2014/068032, entire document, which is a PCT parent to the instant application, dated Aug. 24, 2015.

* cited by examiner

DETERMINING DOMINANT SCENARIOS FOR SLOWING DOWN TRIP SPEEDS

BACKGROUND

Raising a drill string in a borehole filled with drilling fluid at an excessive speed may reduce the hydrostatic pressure of drilling fluids in the borehole below the "pore pressure" of the borehole, allowing fluids to enter the borehole from the surrounding formations. Lowering the drill string into the borehole at an excessive speed may increase the hydrostatic pressure of the drilling fluid above the fracture gradient of the surrounding formations, causing fracturing to occur. Methods have been developed to identify scenarios in which raising and lowering lead to reduction of trip speeds. Identifying the dominant scenario, i.e., the scenario that dictated the lowest trip speed, in order that corrective action can be taken, is a challenge.

DETAILED DESCRIPTION

While the following description is primarily directed to planning a tripping operation on a land-based drilling system using drill pipe, it will be understood that the same techniques could be used in subsea/offshore drilling systems. Further, the same considerations may apply to MWD/LWD, wired drillpipe, coiled tubing (wired and unwired), and wireline embodiments. In addition, the techniques described herein are not limited to use in drilling wells to be used for hydrocarbon production, but are useful in any drilling application that is deep enough that the drilling activities have the possibility of fracturing a formation.

Figure 1:
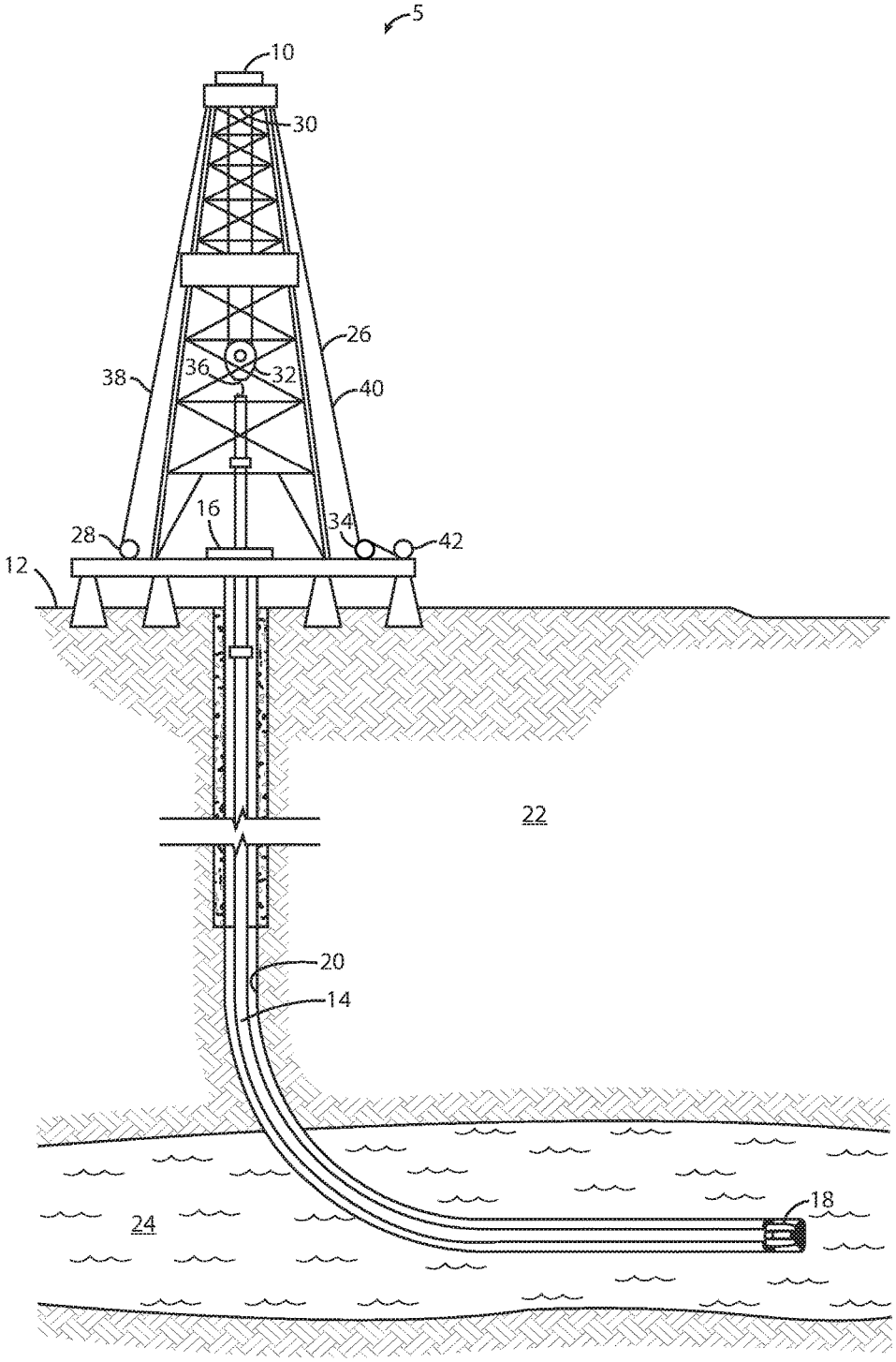
FIG. 1 is a schematic of a drilling system.

In one or more embodiments, a system for drilling operations (or "drilling system") 5, illustrated to in FIG. 1, includes a drilling rig 10 at the surface 12, supporting a drill string 14. In one or more embodiments, the drilling rig supports a tubular string (not shown), such as a string of tubular pipe other than drill pipe, a coiled tubing or a string of wireline or slickline tools. In one or more embodiments, the drill string 14 is an assembly (or "stand") of drill pipe sections which are connected end-to-end through a work platform 16. In one or more embodiments, the length of each stand is described as the "stand length." In one or more embodiments, a drill bit 18 is coupled to the lower end of the drill string 14 and creates the borehole 20 through earth formations 22 and 24 through drilling operations. A first point on the drill string is "lower" (or "deeper") than a second point on the drill string if the first point is at a greater distance from the surface 12 along a borehole 20 than the second point.

In one or more embodiments, the drilling system 5 includes a drill line 26 to raise and lower the drill string 14 in the borehole 20. In one or more embodiments, the drill line 26 is spooled on a winch or draw works 28. In one or more embodiments, the drill line 26 passes from the winch 28 to a crown block 30. The drill line passes from the crown block 30 to a traveling block 32 back to the crown block 30 and to an anchor 34. A hook 36 couples the traveling block 32 to the drill string 14. The crown block 30 and the traveling block 32 act as a block-and-tackle device to provide mechanical advantage in raising and lowering the drill string 14. In one or more embodiments, the drill line 26 includes a fast line 38 that extends from the draw works 28 to the crown block 30 and a deadline 40 that extends from the crown block 30 to the anchor 34. In one or more embodiments, a supply spool 42 stores additional drill line 26 that can be used when the drill line 26 has been in use for some time and is considered worn.

Lowering the drill string 14 into the borehole 20, referred to as "tripping in," involves coupling one or more stands of drill pipe to the top of the drill string 14, lowering the drill string 14 by the length of the one or more stands, and repeating the process. Raising the drill string 14 out of the borehole 20, referred to as "tripping out," involves raising the drill string 14 by the length of one or more stands of drill pipe, removing the exposed stands of drill pipe from the top of the drill string 14, and repeating the process. The speed at which the drill string 14 is tripped out or tripped in is referred to herein as the "trip speed."

Tripping operations (i.e., tripping in and tripping out) are performed regularly in drilling operations in order to attach tools to the drill string, to detach tools from the drill string, to maintain the drill string, and to perform other actions related to the drill string and/or the well being drilled. Such tripping operations have the potential of causing the hydrostatic pressure of drilling fluids in the borehole 20 to fall below the pore pressure or rise above the fracture gradient, as described above. In one or more embodiments, tripping operations are planned to avoid such problems.

In one or more embodiments, a known computer program, referred to herein as SWAB/SURGE, uses data, such as data about the well path, the wellbore, the drill string, drilling fluid, the geothermal context, the formation/subsurface context, the rig, and operation information, to compute the trip speed at which the pressure at a particular depth the borehole 20 is in a range between the pore pressure and the fracture gradient, as the result of a tripping operation. For the purposes of this disclosure, a "step" is defined to be the location in the oil well of a lowest end of the drill string 14, which is typically the location of the bit 18. For the purposes of this disclosure, a "slice" is defined to be a depth in the oil well. Running SWAB/SURGE once for a specified slice will return (a) a default trip speed if that trip speed does not cause the pressure at the specified step to be outside the pore pressure/fracture gradient range, (b) the greatest trip speed, which is less than the default trip speed, that does not does not cause the pressure at the specified step to be outside the pore pressure/fracture gradient range, or (c) an indication that the trip speed calculation does not converge, indicating that a trip speed that does not cause the pressure at the specified step to be outside the pore pressure/fracture gradient range cannot be calculated.

Thus, the known SWAB/SURGE computer program performs the following functions:

i. establishing a pore pressure for the slice,
ii. establishing a fracture pressure for the slice,
iii. establishing a default trip speed, which is defined to be a default speed that a drill string moves longitudinally (i.e., in and out) within the oil well,
iv. calculating a pressure at the slice as a function of the step location and the default trip speed,
v. determining that the calculated pressure is outside a range defined by the pore pressure for the slice and the fracture pressure for the slice, and
vi. iteratively adjusting the trip speed and recalculating the pressure at the slice until the recalculated pressure falls within the range.

Figure 2:
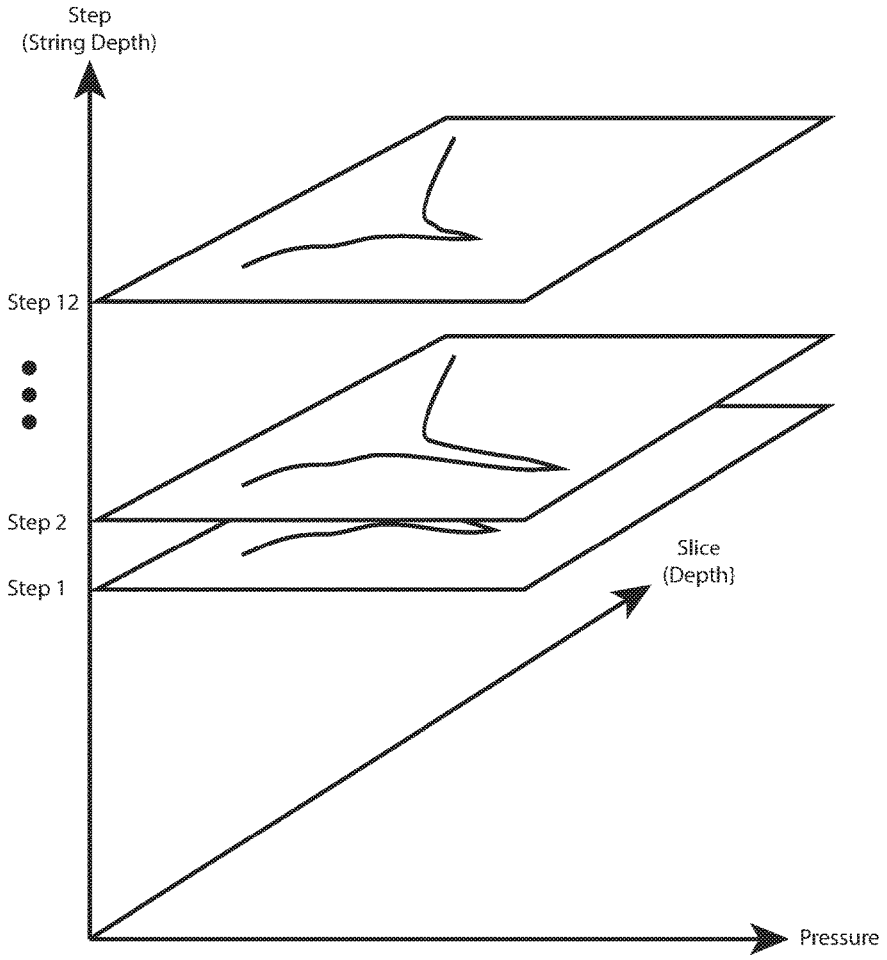
FIG. 2 is a graph showing the relationship between step, slice, and pressure.

The relationship between step, slice, and pressure can be represented as a 3 dimensional surface in step/slice/pressure space, as illustrated in FIG. 2. FIG. 2 shows three cross-sections (at step 1, step 2, and step 12 along the step dimension) of the surface, but it will be understood that the surface is continuous between the slices shown and beyond to the extent of the borehole 20.

Figure 3A:
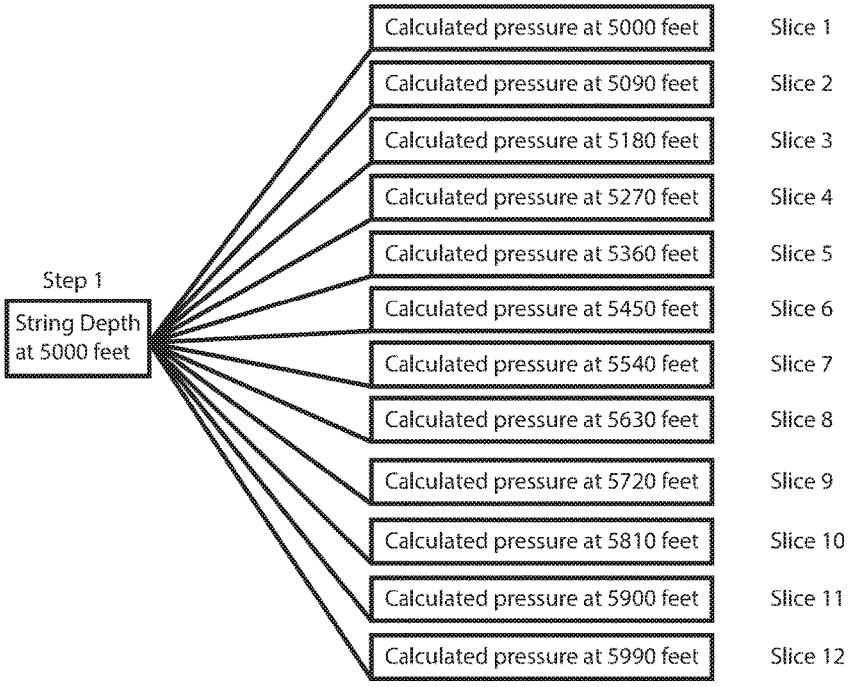
FIGS. 3A and 3B are charts showing the relationship between steps and slices.
Figure 3B:
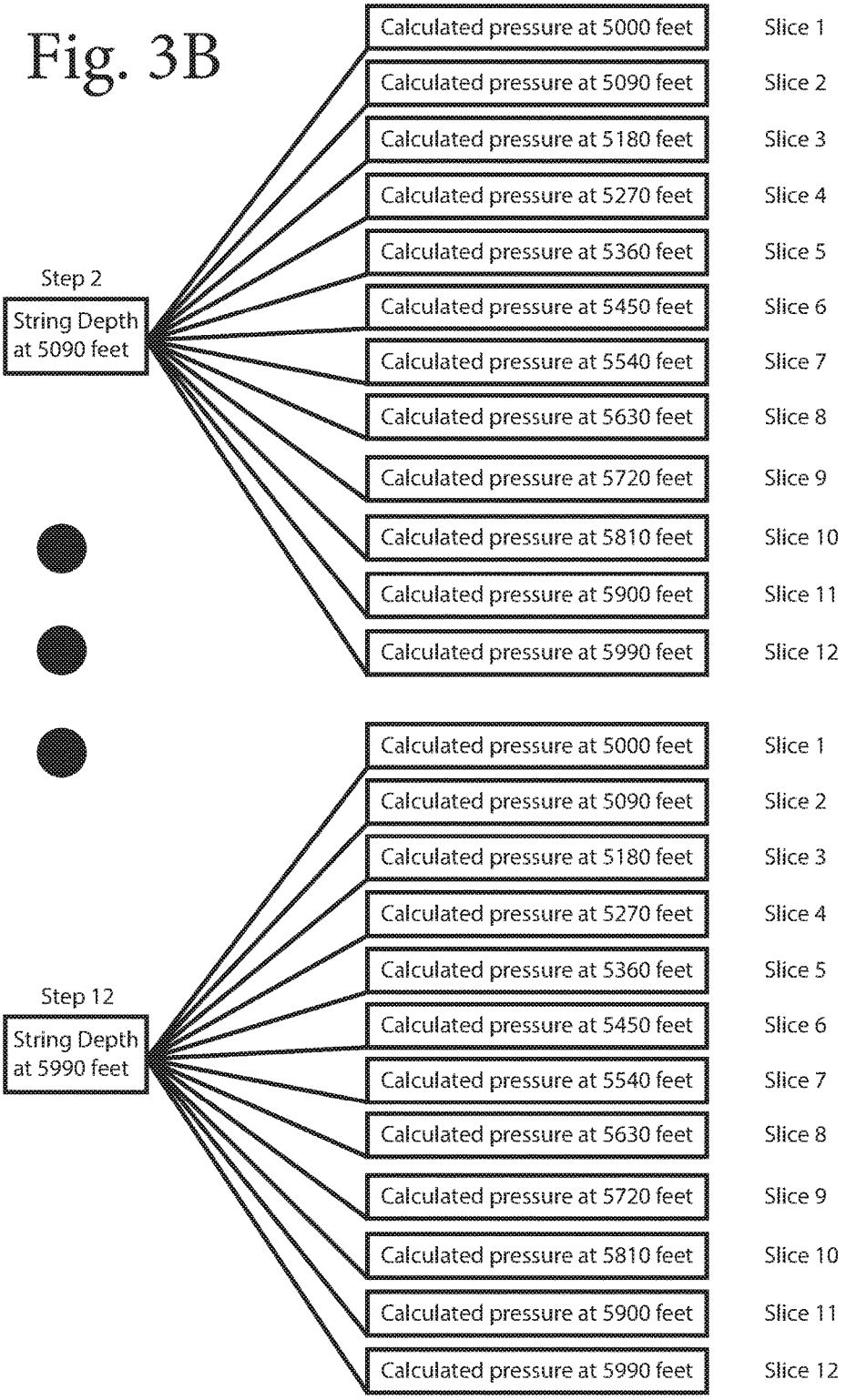

In one or more embodiments, illustrated in FIGS. 3A and 3B, rather than calculating the entire surface, discrete points on the surface are calculated. In one or more embodiments, the calculated points are randomly distributed over the surface. In one or more embodiments, the calculated points are regularly distributed over the surface. In one or more embodiments, the calculated points are distributed over the surface in "string depth increments" of string depth and "slice increments" of slice. In one or more embodiments, the step increments are the length of one stand of pipe. In one or more embodiments, the slice increments are the length of one stand of pipe. For example, FIG. 3A shows the pressure calculated at 12 slices (every stand length increment, where stand length=90 feet, from 5000 feet to 5990 feet) for step 1, where string depth=5000 feet. FIG. 3B shows the pressure calculated at the same 12 slices for step 2, where string depth=5090 (one stand length increment from step 1), an ellipsis representing steps 3 through 11, each a stand length increment from the previous step, and the pressure calculated at the same slice 12 slices for step 12, where the string depth is 5990 feet.

Figure 4:
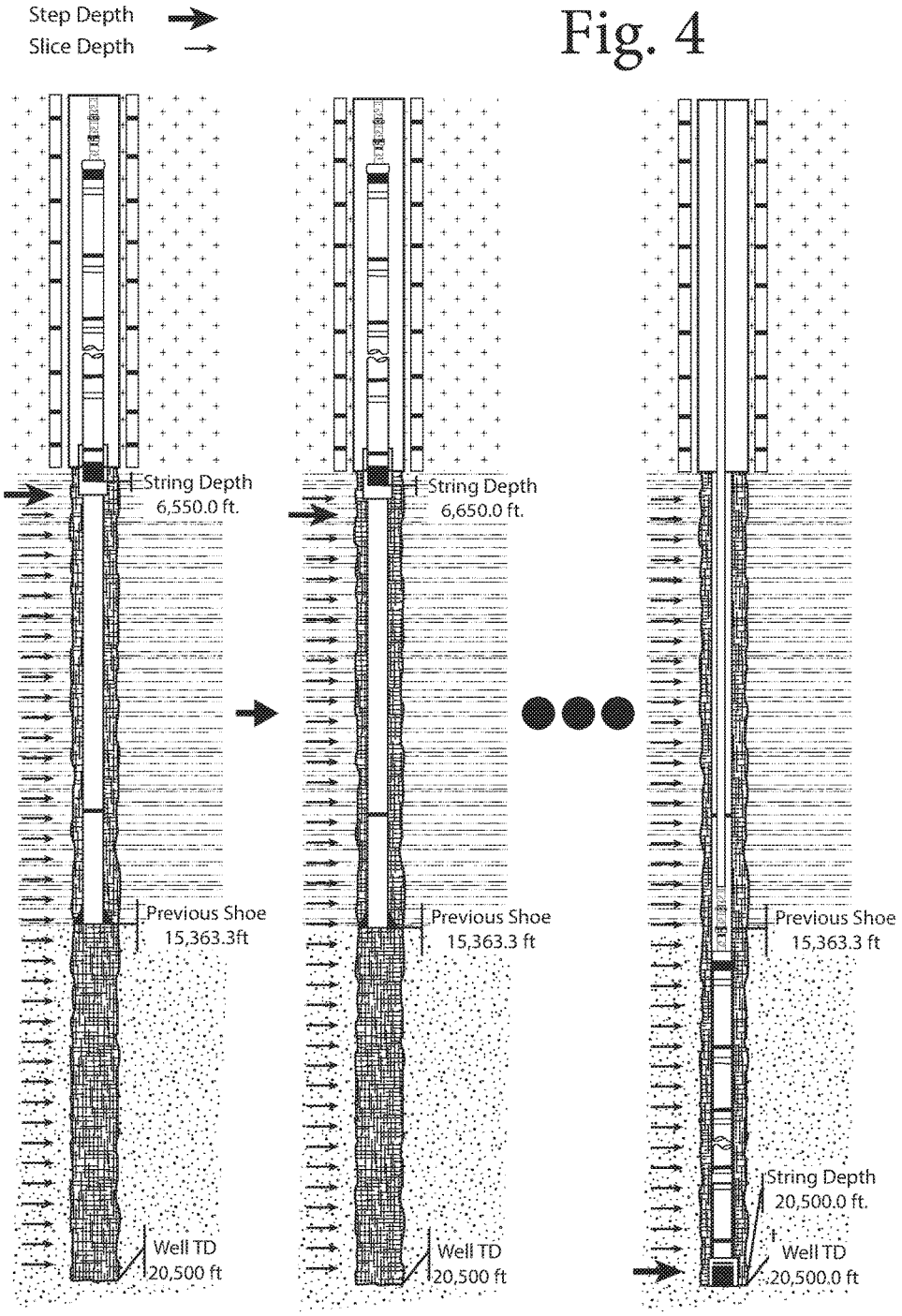
FIG. 4 is a series of well schematics illustrating the relationship between steps and slices.

Steps and slices are illustrated graphically in FIG. 4 by a series of well schematics. FIG. 4 illustrates a series of steps proceeding from left to right, with each step being represented by a well schematic and with an the ellipsis shown between the second and third well schematic representing a plurality of steps. In each well schematic, the step depth is represented by a single heavy arrow and the slice depths for that step are represented by multiple light arrows arrayed along the borehole.

Figure 5:
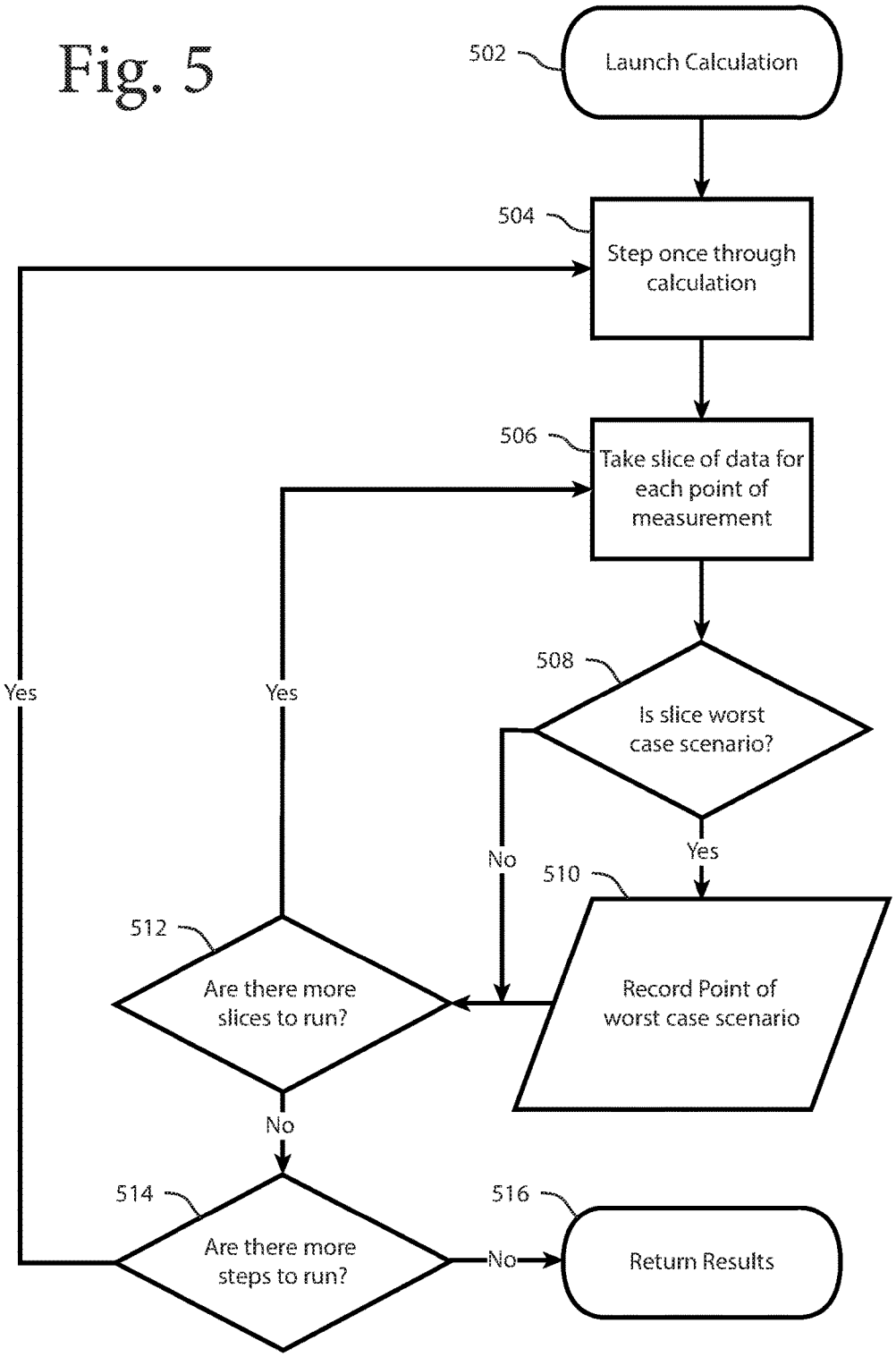
FIG. 5 is a flow chart showing calculation logic.

In one or more embodiments, illustrated in FIG. 5, a process reduces the amount of data to be used for analysis of dominant scenarios for slowing down trip speed. In one or more embodiments, the calculation to reduce the data is launched (block 502). In one or more embodiments, the calculation is stepped through once (block 504), meaning that the calculation is performed for specified string depths over a specified interval. In one or more embodiments, the specified interval is a depth interval (e.g., 5000 feet to 6000 feet). In one or more embodiments, the specified string depths are evenly distributed within the specified interval. In one or more embodiments, the specified string depths are separated by a predetermined distance, such as a stand length (e.g., 90 feet; if the specified interval is 5000 to 6000 feet, the specified string depths would be at 5000, 5090, 5018, 5270, 5360, 5450, 5540, 5630, 5720, 5810, 5900, and 5990 feet).

In one or more embodiments, the process takes (e.g., computes using SWAB/SURGE) a slice of data for each point of measurement (block 506). For example, in the example described above, a slice of data is taken at specified depth intervals along the specified string for a given step. In one or more embodiments, all of the slices of data for a given step are computed before moving to the next block of computation. In one or more embodiments, each slice is analyzed as described below before subsequent slices are computed.

In one or more embodiments, the process determines if the slice is the worst case scenario (i.e., the lowest trip speed) recorded for this string depth (block 508). If it is ("Yes" branch from block 508), data for that slice is recorded in a trip speed table (block 510) and the process determines if there are any more slices to run (block 512). If it is not ("No" branch from block 508), the data for that slice is not stored in the trip speed table and the process moves to block 512.

In one or more embodiments, if there are more slices to run ("Yes" branch out of block 512), the process returns to block 506. If there are not more slices to run ("No" branch out of block 512), the process determines if there are more steps to run (block 514). If there are more steps to run ("Yes" branch out of block 514), the process returns to block 504 to process the next step. If there are no more steps to run ("No" branch out of block 514), the process returns the results. In one or more embodiments, the results are stored in the trip speed table, such as the example shown in Table 1 below:

TABLE 1

Calculation Example of 5000-6000 ft calculation with stand length = 90 ft

| String Depth | Trip Speed | Depth of slice where minimum speed was recorded |
|---|---|---|
| 5000 | 60 | 6000 |
| 5090 | 60 | 6000 |
| 5180 | 60 | 6000 |
| 5270 | 35 | 5090 |
| 5360 | 45 | 5180 |
| 5450 | 45 | 5270 |
| 5540 | 45 | 5360 |
| 5630 | 50 | 5450 |
| 5720 | 60 | 6000 |
| 5810 | 60 | 6000 |
| 5900 | 60 | 6000 |
| 5990 | 60 | 6000 |

As can be seen in Table 1, a "trip speed" and the "depth of the slice where the minimum speed was recorded" is recorded for each string depth (or step).

Figure 6:
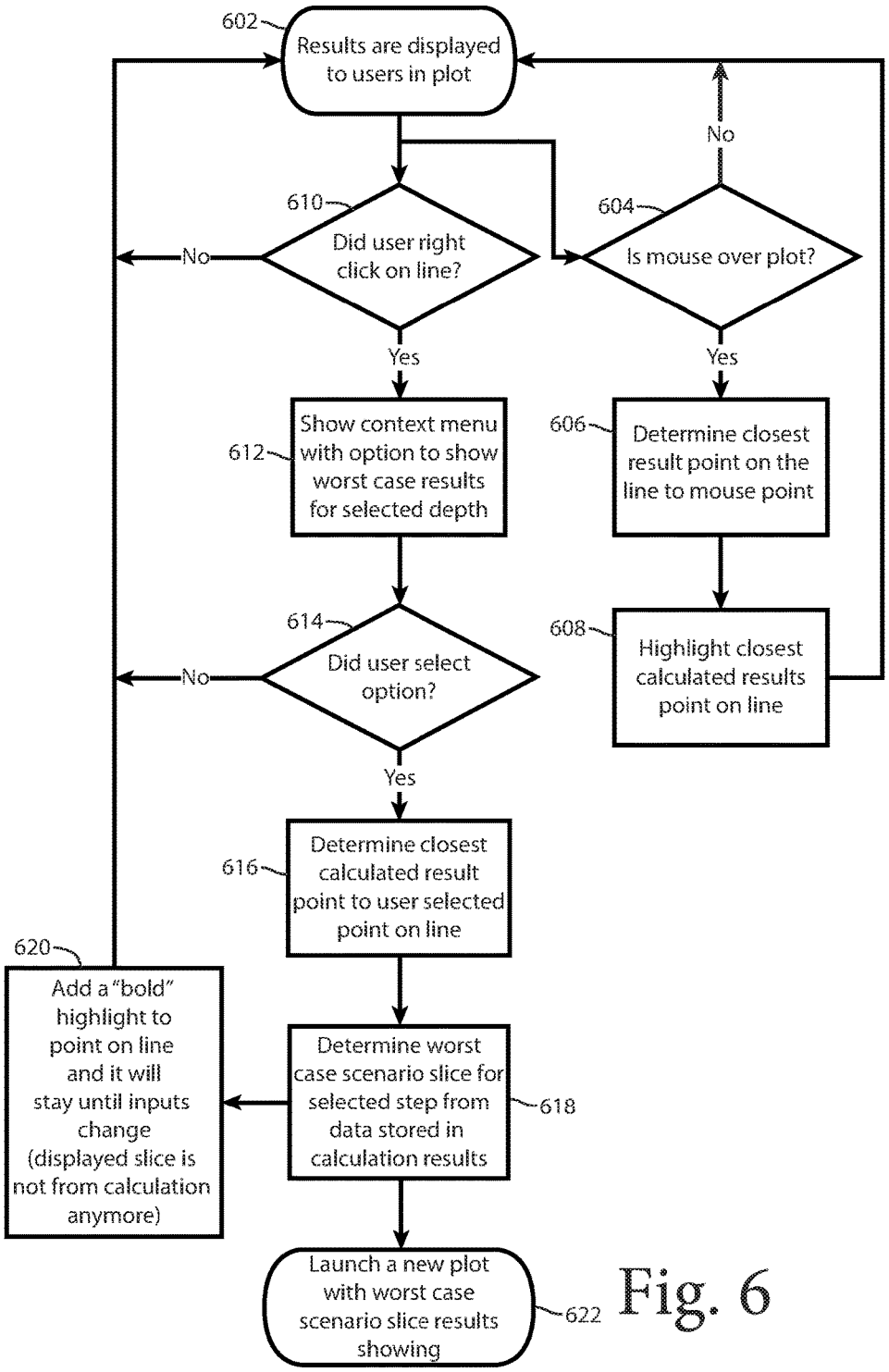
FIG. 6 is a flow chart showing application logic.
Figure 7:
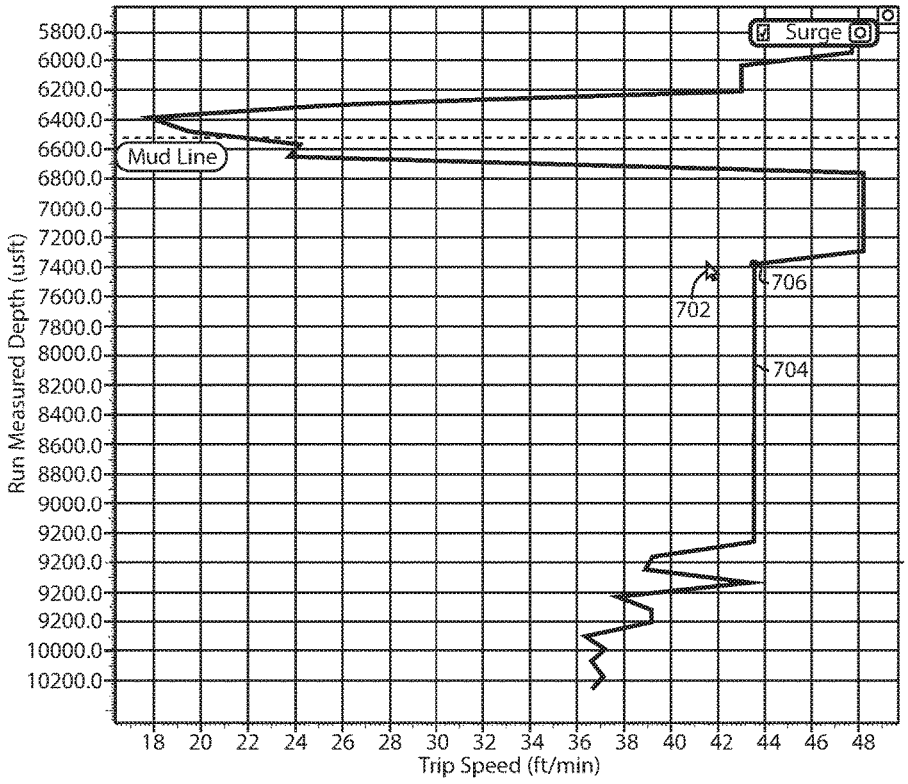
FIG. 7 is a screen shot showing a plot of maximum trip speed versus run measured depth and a point on the plot being selected.

In one or more embodiments, illustrated in FIG. 6, a process for visualizing the data recorded in the trip speed table is executed. In one or more embodiments, the data recorded in the trip speed table are displayed to users in a plot (block 602), such as is shown in FIG. 7. In one or more embodiments, the plot in FIG. 7 shows the maximum trip speed in feet per minute (ft/min), shown in the horizontal axis, over a run measured depth interval between 5800 and 10200 feet (ft), shown in the vertical axis. In one or more embodiments, the mud line is shown by a dashed line and a "Mud Line" legend; in the example in FIG. 7, the mud line is at about 6500 ft.

In one or more embodiments, the process determines if the mouse is over the plot (block 604). If it is ("Yes" branch out of block 604), the process determines the closest result point on the line to the mouse point (block 606). In one or more embodiments, the process highlights the closest calculated results point on the line (block 608). In one or more embodiments, if the mouse is not over the plot, ("No" branch out of block 604) the process loops back to block 602. This highlighting process is illustrated in FIG. 7. In one or more embodiments, the mouse cursor 702 is shown near the line 704 and the closest result point to the mouse point is highlighted by a small circle 706. In one or more embodiments, it is not necessary for the mouse cursor 702 to be directly over the line 704. In one or more embodiments, when the mouse cursor 702 is placed within a user-defined distance of the line 704 the highlighting circle 706 appears. In one or more embodiments, the user-defined distance is 0.1 inch. In one or more embodiments, the user-defined distance is 0.2 inch. In one or more embodiments, the user-defined distance is 0.5 inch. In one or more embodiments, the user-defined distance is 10 pixels. In one or more embodiments, the user-defined distance is 20 pixels. In one or more embodiments, the user-defined distance is 50 pixels.

Figure 8:
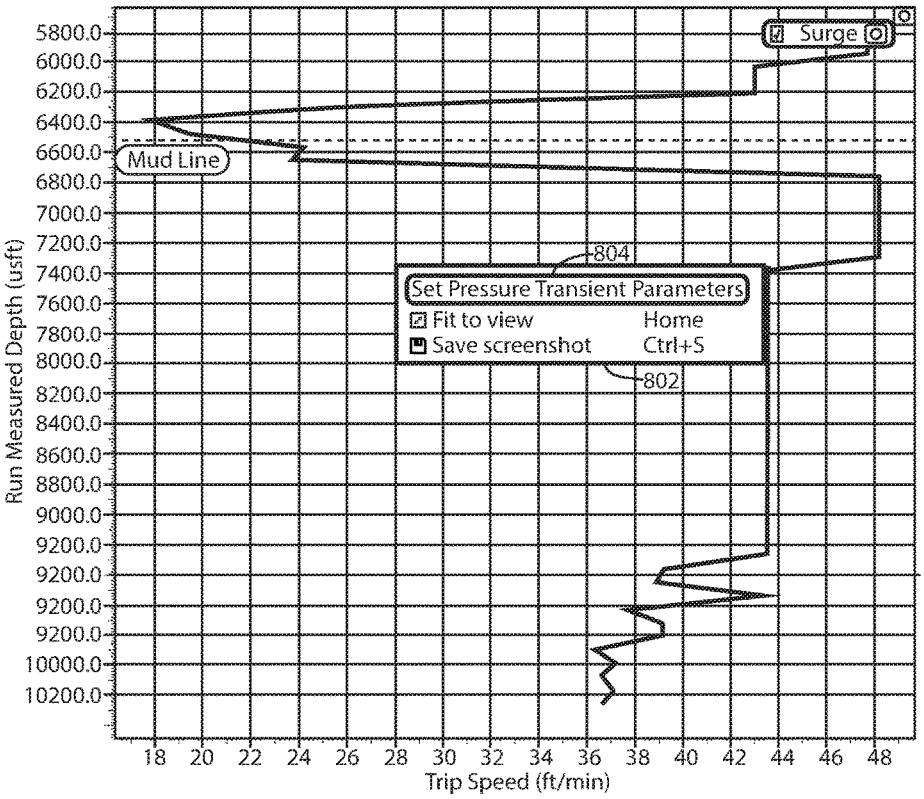
FIG. 8 is a screen shot showing the plot of FIG. 7 with the addition of a context menu.

In one or more embodiments, at the same time that the process described in blocks 604, 606, and 608 is running, a parallel process is running. In one or more embodiments, the parallel process determines if the user right clicked on the line (block 610). In one or more embodiments, if the user right-clicks on (or near, as discussed above) the line ("Yes" branch out of block 610), the process shows a context menu 802 with the option to show the worst case results for the selected depth (block 612), as illustrated in FIG. 8. In one or more embodiments, the context menu 802 includes a "Set Pressure Transient Parameters" button 804. In one or more embodiments, if the button 804 is pressed, the highlighting circle 706 is emphasized, for example by increasing its size or changing its color or by some other visual indication, to produce the bold circle 902 shown in FIG. 9. In one or more embodiments, at the same time (perhaps on another screen) or within a few seconds (i.e., in one or more embodiments, within 5 seconds; in one or more embodiments, within 10 seconds; in one or more embodiments, within 20 seconds), the well schematic and plot shown in FIG. 10 is displayed.

Figure 9:
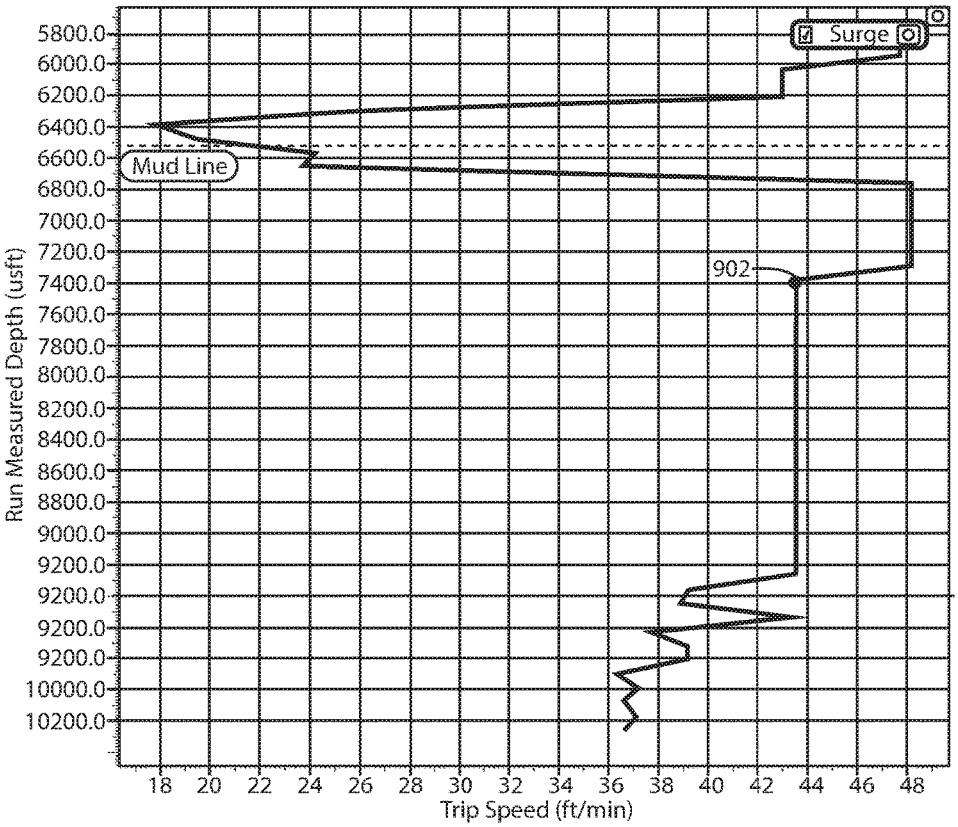
FIG. 9 is a screen shot showing the plot of FIG. 7 with the selected point on the plot being highlighted.
Figure 10:
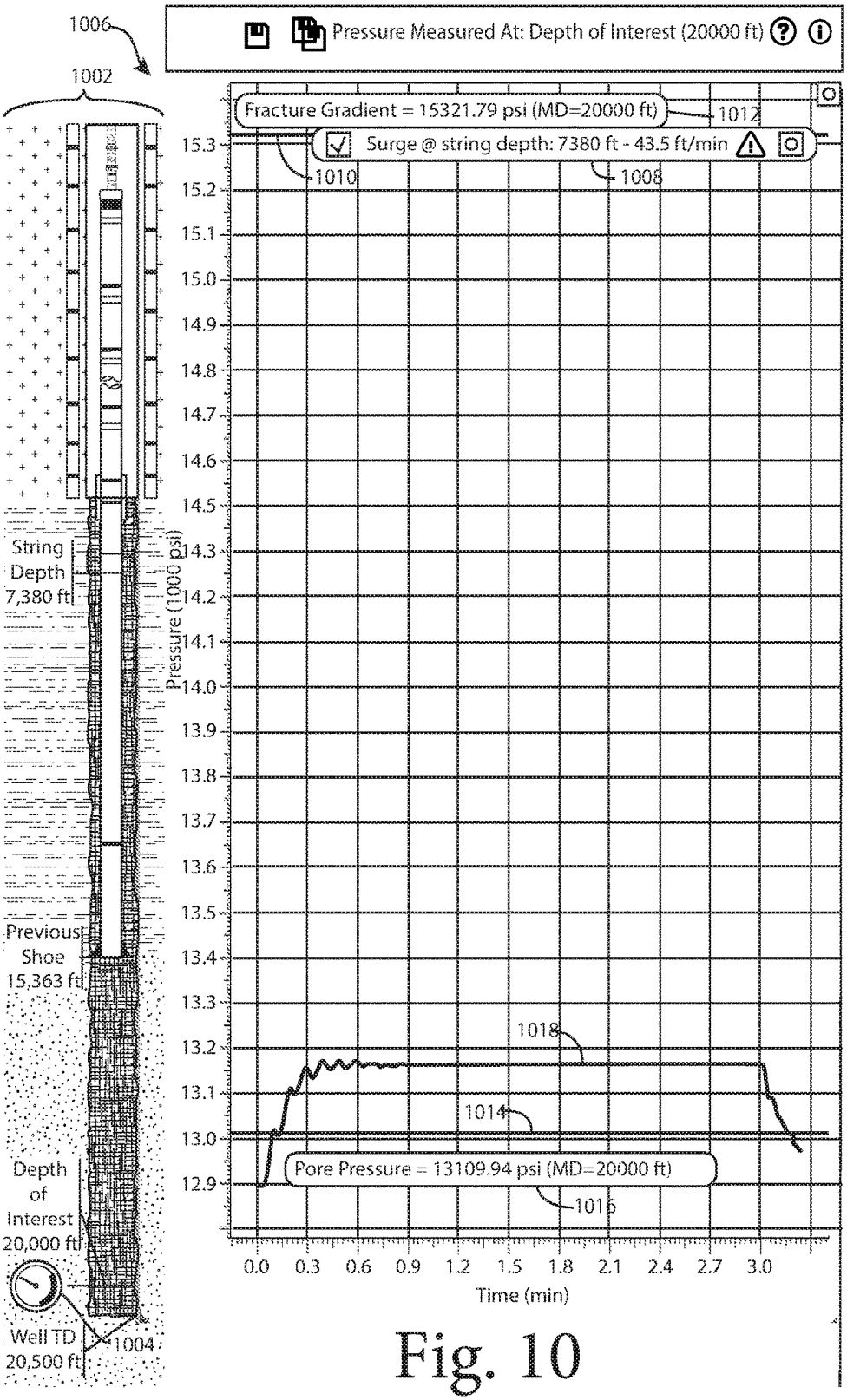
FIG. 10 is a screen shot showing a plot of pressure at a slice at a depth of interest versus time for a drill string moving at a trip speed that resulted in the pressure at the slice at the depth of interest being outside a pore pressure/fracture gradient pressure range.

In one or more embodiments, in creating the well schematic and plot shown in FIG. 10, the closest point to the user selected point on the line is determined (block 616). In one or more embodiments, the following inputs from the screen shown in FIG. 9 are used to make this determination:

1. String depth (from the y-axis position of the mouse or the bold circle 902),
2. Trip speed (from the x-axis position of the mouse or the bold circle 902).

In one or more embodiments, the bold circle 902 is added and stays until the inputs change such that the displayed slice is not from calculation anymore (block 620). In one or more embodiments, a new plot is launched showing the worst case scenario slice results (i.e., borehole pressure curve 1018, discussed below) (block 622).

In one or more embodiments, the worst case scenario slice (or "depth of interest") for the selected step is determined from data stored in the calculation results (i.e., the trip speed table (Table 1 above)) (block 618).

In one or more embodiments, the well schematic and plot shown in FIG. 10 includes:

1. a well schematic 1002 on the left side of the screen that includes:
   a. a label for string depth (at 7,380 feet in the illustrated example),
   b. a label for the previous shoe depth (at 15,363 feet in the illustrated example),
   c. a label for the depth of interest (20,000 feet in the example shown),
   d. a label for the total depth of the well (20,500 feet in the example shown), and
   e. a "meter" symbol 1004 that highlights the depth of interest.
2. a plot area 1006 on the right side of the screen that includes:
   a. a vertical axis showing pressure in pounds per square inch (psi),
   b. a horizontal axis showing time (in minutes (min)) that the drill string 14 has been tripping into or out of the borehole 20 at the trip speed being investigated (43.5 ft/min in the illustrated example, as indicated in the legend 1008),
   c. a fracture gradient line 1010 showing the fracture gradient at the depth of interest (15321.79 pounds per square inch (psi) at the measured depth (MD) of interest of 20,000 feet as shown in the legend 1012),
   d. a pore pressure line 1014 showing the pore pressure at the depth of interest (13109.94 psi at the MD of interest of 20000 feet, as shown in legend 1016), and
   e. a borehole pressure curve 1018, which is computed when the "Set Pressure Transient Parameters" button is pressed, showing the borehole pressure at the depth of interest over time.

The pressure curve 1018 illustrates the kind of problem the technique is intended to identify. As can be seen, the borehole pressure is below the pore pressure from time=0.0 min until approximately time=0.15 min. During that time, fluids would be drawn from the formation into the borehole, which is not desirable.

In one or more embodiments, armed with this information, users planning the drilling of the well could revise the drill plan by, for example:

a. changing the diameter of the borehole, b. changing the diameter of one or more elements of the drill string, c. changing the geometry (i.e., the number and location of bends in the borehole), d. and other similar measures.

In general, in one aspect, the disclosure features a method. The method includes a processor creating a trip speed table comprising records. Each record contains a step location, wherein a step is defined to be the location in a well of a deepest end of a drill string, a minimum trip speed for the step location, wherein the minimum trip speed is defined to be the maximum trip speed less than or equal to a default trip speed at which the drill string can be tripped without exceeding a fracture gradient or falling below a pore pressure at a slice depth, and the slice depth where the minimum trip speed for the step location occurred.

Implementations may include one or more of the following. The processor may display a plot of step location versus minimum trip speed from the trip speed table. The processor may accept selection of a step location and a trip speed on the plot. The processor may access from the trip speed table the slice depth for the selected step location and selected trip speed. The processor may display a plot of pressure versus time for the pressure at the accessed slice depth for the selected step location and selected trip speed.

In general, in another aspect, the disclosure features a method. The method includes accessing data about a well.

The method includes, for each of a plurality of steps, wherein a step is defined to be the location in the well of a deepest end of a tubular string, a processor performing the following elements a-c using the data:

a. for each of a plurality of slices, wherein a slice is defined to be a depth in the well, performing the following elements i-vi:
   i. establishing a pore pressure for the slice, which is defined to be the pressure of the formation fluids at the location of the slice in the well,
   ii. establishing a fracture gradient for the slice, which is defined to be the pressure above which the formation at the location of the slice in the well will fracture,
   iii. establishing a default trip speed, which is defined to be a default speed that a tubular string moves longitudinally within the well,
   iv. calculating a pressure at the slice as a function of the step location and the default trip speed,
   v. determining that the calculated pressure is outside a range defined by the pore pressure for the slice and the fracture gradient for the slice, and
   vi. iteratively adjusting the trip speed and recalculating the pressure at the slice until the recalculated pressure falls within the range; and
b. determining, for one of the plurality of slices, that the trip speed at which the pressure at the slice fell within the range is the minimum trip speed that has been encountered for the step;
c. storing in a trip speed table the step location, the minimum trip speed for the step location, and the slice depth where the minimum trip speed for the slice occurred; and The method further includes the processor accessing the trip speed table when planning a tripping operation on the drill string. The method further includes adjusting the tripping operation in light of the trip speed table.

Implementations may include one or more of the following. Accessing the trip speed table may include the processor displaying on a display: a trip speed axis, a run measured depth axis, and a curve depicting minimum trip speed versus step location from the trip speed table. Accessing the trip speed table may further include detecting a click near the curve at a click location. Accessing the trip speed table may further include displaying on the display a context menu with an option to show the worst case results. Accessing the trip speed table may further include detecting a selection of the option to show the worst case results. Accessing the trip speed table may further include determining a string depth for the click location. Accessing the trip speed table may further include determining a trip speed for the click location. Accessing the trip speed table may further include determining a depth of interest value for the determined string depth and the determined trip speed by finding a record in the trip speed table containing the determined string depth and the determined trip speed and accessing the slice depth where the minimum trip speed for the slice occurred from the found record. Accessing the trip speed table may further include displaying on the display a plot of a pressure axis, a time axis, and a curve depicting pressure versus time at the depth of interest for the determined trip speed. The method of claim 4 wherein displaying the plot may include displaying on the display a line indicating the pore pressure at the depth of interest, and a line indicating the fracture gradient at the depth of interest. Determining string depth may include comparing the click location to the run measured depth axis. Determining trip speed may include comparing the click location to the trip speed axis. The method may further include highlighting the closest point on the curve to the click location. Accessing the trip speed table further may include the processor displaying on the display a schematic of the well including an indication of the string depth, and an indication of the location of the worst case scenario slice. The schematic and the plot may be displayed simultaneously. Detecting a click near the curve at a click location may include detecting a click on the curve at the click location. Detecting a click near the curve at a click location may include detecting a click within a predetermined distance along a line from the click location to a point on the curve closest to the click location.

In general, in another aspect, the disclosure features a method. The method includes a processor displaying on a display a trip speed axis, a run measured depth axis, and a curve depicting minimum trip speed versus step location from a trip speed table. The method further includes the processor displaying detecting a click near the curve at a click location. The method further includes the processor displaying on the display a context menu with an option to show the worst case results. The method further includes the processor displaying detecting a selection of the option to show the worst case results. The method further includes the processor determining a string depth for the click location. The method further includes the processor determining a trip speed for the click location. The method further includes the processor determining a depth of interest value for the determined string depth and the determined trip speed by finding a record in the trip speed table containing the determined string depth and the determined trip speed and accessing the depth of interest value from the found record. The method further includes the processor displaying on the display a plot of a pressure axis, a time axis, and a curve depicting pressure versus time at the depth of interest for the determined trip speed.

In general, in another aspect, the disclosure features a non-transitory computer-readable medium on which is recorded a computer program comprising executable instructions, that, when executed, perform a method. The method includes creating a trip speed table comprising records. Each record contains a step location, wherein a step is defined to be the location in a well of a deepest end of a drill string, a minimum trip speed for the step location, wherein the minimum trip speed is defined to be the maximum trip speed less than or equal to a default trip speed at which the drill string can be tripped without exceeding a fracture gradient or falling below a pore pressure at a slice depth, and the slice depth where the minimum trip speed for the step location occurred.

In general, in another aspect, the disclosure features a non-transitory computer-readable medium on which is recorded a computer program comprising executable instructions, that, when executed, perform a method. The method includes for each of a plurality of steps, wherein a step is defined to be the location in the well of a deepest end of a tubular string, performing the following elements a-c using the data:

a. for each of a plurality of slices, wherein a slice is defined to be a depth in the well, performing the following elements i-vii:
   i. establishing a pore pressure for the slice, which is defined to be the pressure of the formation fluids at the location of the slice in the well,
   ii. establishing a fracture gradient for the slice, which is defined to be the pressure above which the formation at the location of the slice in the well will fracture, iii. establishing a default trip speed, which is defined to be a default speed that a tubular string moves longitudinally within the well, iv. calculating a pressure at the slice as a function of the step location and the default trip speed, v. determining that the calculated pressure is outside a range defined by the pore pressure for the slice and the fracture gradient for the slice, and vi. iteratively adjusting the trip speed and recalculating the pressure at the slice until the recalculated pressure falls within the range; and b. determining, for one of the plurality of slices, that the trip speed at which the pressure at the slice fell within the range is the minimum trip speed that has been encountered for the step;

c. storing in a trip speed table the step location, the minimum trip speed for the step location, and the slice depth where the minimum trip speed for the slice occurred;

The method further includes accessing the trip speed table when planning a tripping operation on the drill string. The method further includes adjusting the tripping operation in light of the trip speed table.

In general, in another aspect, the disclosure features a non-transitory computer-readable medium on which is recorded a computer program comprising executable instructions, that, when executed, perform a method. The method includes displaying on a display a trip speed axis, a run measured depth axis, and a curve depicting minimum trip speed versus step location from a trip speed table. The method further includes detecting a click near the curve at a click location. The method further includes displaying on the display a context menu with an option to show the worst case results. The method further includes detecting a selection of the option to show the worst case results. The method further includes determining a string depth for the click location. The method further includes determining a trip speed for the click location. The method further includes determining a depth of interest value for the determined string depth and the determined trip speed by finding a record in the trip speed table containing the determined string depth and the determined trip speed and accessing the slice depth where the minimum trip speed for the slice occurred from the found record. The method further includes displaying on the display a plot of a pressure axis, a time axis, and a curve depicting pressure versus time at the depth of interest for the determined trip speed.

References in the specification to "one or more embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Embodiments of the invention include features, methods or processes that may be embodied within machine-executable instructions provided by a machine-readable medium. A computer-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a computer-readable medium includes non-transitory volatile and/or non-volatile media (e.g., read only memory (ROM), random access memory (RAM), magnetic disk storage media, optical storage media, flash memory devices, etc.), as well as transitory electrical, optical, acoustical or other form of propagated signals (e.g., carrier waves, infrared signals, digital signals, etc.).

Such instructions are utilized to cause a general or special purpose processor, programmed with the instructions, to perform methods or processes of the embodiments of the invention. Alternatively, the features or operations of embodiments of the invention are performed by specific hardware components which contain hard-wired logic for performing the operations, or by any combination of programmed data processing components and specific hardware components. One or more embodiments of the invention include software, data processing hardware, data processing system-implemented methods, and various processing operations, further described herein.

One or more figures show block diagrams of systems and apparatus for a system for monitoring hookload, in accordance with one or more embodiments of the invention. One or more figures show flow diagrams illustrating operations for monitoring hookload, in accordance with one or more embodiments of the invention. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method comprising:

accessing data about a well;

for each of a plurality of steps, wherein a step is defined to be the location in the well of a deepest end of a tubular string, a processor performing the following elements a-c using the data:

a. for each of a plurality of slices, wherein a slice is defined to be a depth in the well, performing the following elements i-vi:

i. establishing a pore pressure for the slice, which is defined to be the pressure of the formation fluids at the location of the slice in the well, ii. establishing a fracture gradient for the slice, which is defined to be the pressure above which the formation at the location of the slice in the well will fracture, iii. establishing a default trip speed, which is defined to be a default speed that the tubular string moves longitudinally within the well, iv. calculating a pressure at the slice as a function of the step location and the default trip speed, v. determining that the calculated pressure is outside a range defined by the pore pressure for the slice and the fracture gradient for the slice, and vi. iteratively adjusting the trip speed and recalculating the pressure at the slice until the recalculated pressure falls within the range; and b. determining, for one of the plurality of slices, that the trip speed at which the pressure at the slice fell within the range is the minimum trip speed that has been encountered for the step;

c. storing in a trip speed table the step location, the minimum trip speed for the step location, and the slice depth where the minimum trip speed for the slice occurred; and the processor accessing the trip speed table when planning a tripping operation on the drill string;

adjusting the tripping operation in light of the trip speed table.

2. The method of claim 1 wherein accessing the trip speed table comprises the processor:

displaying on a display:

a trip speed axis, a run measured depth axis, and a curve depicting minimum trip speed versus step location from the trip speed table;

detecting a click near the curve at a click location;

displaying on the display a context menu having an option to show a worst case result;

detecting a selection of the option to show the worst case results;

determining a string depth for the click location;

determining a trip speed for the click location;

determining a depth of interest value for the determined string depth and the determined trip speed by finding a record in the trip speed table containing the determined string depth and the determined trip speed and accessing the slice depth where the minimum trip speed for the slice occurred from the found record; and displaying on the display a plot of:

a pressure axis, a time axis, and a curve depicting pressure versus time at the depth of interest for the determined trip speed.

3. The method of claim 2 wherein displaying the plot comprises:

displaying on the display:

a line indicating the pore pressure at the depth of interest, and a line indicating the fracture gradient at the depth of interest.

4. The method of claim 2 wherein:

determining string depth comprises comparing the click location to the run measured depth axis; and determining trip speed comprises comparing the click location to the trip speed axis.

5. The method of claim 2 further comprising:

highlighting the closest point on the curve to the click location.

6. The method of claim 2 wherein accessing the trip speed table further comprises the processor:

displaying on the display a schematic of the well comprising:

an indication of the string depth, and an indication of the location of the worst case scenario slice.

7. A non-transitory computer-readable medium on which is recorded a computer program comprising executable instructions, that, when executed, perform a method comprising:

accessing data about a well;

for each of a plurality of steps, wherein a step is defined to be the location in the well of a deepest end of a tubular string, performing the following elements a-c using the data:

a. for each of a plurality of slices, wherein a slice is defined to be a depth in the well, performing the following elements i-vi:

i. establishing a pore pressure for the slice, which is defined to be the pressure of the formation fluids at the location of the slice in the well, ii. establishing a fracture gradient for the slice, which is defined to be the pressure above which the formation at the location of the slice in the well will fracture, iii. establishing a default trip speed, which is defined to be a default speed that the tubular string moves longitudinally within the well, iv. calculating a pressure at the slice as a function of the step location and the default trip speed, v. determining that the calculated pressure is outside a range defined by the pore pressure for the slice and the fracture gradient for the slice, and vi. iteratively adjusting the trip speed and recalculating the pressure at the slice until the recalculated pressure falls within the range; and b. determining, for one of the plurality of slices, that the trip speed at which the pressure at the slice fell within the range is the minimum trip speed that has been encountered for the step;

c. storing in a trip speed table the step location, the minimum trip speed for the step location, and the slice depth where the minimum trip speed for the slice occurred;

accessing the trip speed table when planning a tripping operation on the drill string; and adjusting the tripping operation in light of the trip speed table.

8. The non-transitory computer-readable medium of claim 7 wherein accessing the trip speed table comprises:

displaying on a display:

a trip speed axis, a run measured depth axis, and a curve depicting minimum trip speed versus step location from the trip speed table;

detecting a click near the curve at a click location;

displaying on the display a context menu having an option to show a worst case result;

detecting a selection of the option to show the worst case results;

determining a string depth for the click location;

determining a trip speed for the click location;

determining a depth of interest value for the determined string depth and the determined trip speed by finding a record in the trip speed table containing the determined string depth and the determined trip speed and accessing the slice depth where the minimum trip speed for the slice occurred from the found record; and displaying on the display a plot of:

a pressure axis, a time axis, and a curve depicting pressure versus time at the depth of interest for the determined trip speed.

9. The non-transitory computer-readable medium of claim 8 wherein accessing the trip speed table further comprises:

displaying on the display a schematic of the well comprising:

an indication of the string depth, and an indication of the location of the worst case scenario slice.

10. The non-transitory computer-readable medium of claim 9 wherein the schematic and the plot are displayed simultaneously.

11. The non-transitory computer-readable medium of claim 8 wherein detecting a click near the curve at a click location comprises detecting a click on the curve at the click location.

12. The non-transitory computer-readable medium of claim 8 wherein detecting a click near the curve at a click location comprises detecting a click within a pre-determined distance along a line from the click location to a point on the curve closest to the click location.

* * * * *